US005664051A

United States Patent [19]

Hardwick et al.

[11] Patent Number: 5,664,051

[45] Date of Patent: *Sep. 2, 1997

[54] METHOD AND APPARATUS FOR PHASE SYNTHESIS FOR SPEECH PROCESSING

[75] Inventors: John C. Hardwick, Cambridge; Jae S. Lim, Winchester, both of Mass.

[73] Assignee: Digital Voice Systems, Inc., Burlington, Mass.

[ * ] Notice: The term of this patent shall not extend beyond the expiration date of Pat. No. 5,081,681.

[21] Appl. No.: 265,492

[22] Filed: Jun. 23, 1994

Related U.S. Application Data

[63] Continuation of Ser. No. 814, Jan. 5, 1993, abandoned, which is a continuation of Ser. No. 587,250, Sep. 24, 1990, abandoned.

[51] Int. Cl.[6] ..... G10L 3/02

[52] U.S. Cl. ..... 704/206; 704/205; 704/207; 704/208; 704/268

[58] Field of Search ..... 395/2.14–2.19, 395/2.67, 2.77; 381/29–41

[56] References Cited

U.S. PATENT DOCUMENTS

| | | | |
|---|---|---|---|
| 3,982,070 | 9/1976 | Flanagan | 179/1 |
| 3,995,116 | 11/1976 | Flanagan | 179/1 |
| 4,856,068 | 8/1989 | Quatieri et al. | 381/47 |
| 5,054,072 | 10/1991 | McAulay et al. | 381/31 |

OTHER PUBLICATIONS

Griffin, et al., "A New Pitch Detection Algorithm", Digital Signal Processing, No. 84, pp. 395–399, 1984.

Griffin, et al., "A New Model-Based Speech Analysis/Synthesis System", IEEE International Conference on Acoustics, Speech, and Signal Processing, ICASSP 1985, pp. 513–516.

McAulay, et al., "Mid-Rate Coding Based on a Sinusoidal Representation of Speech", IEEE 1985, pp. 945–948.

McAulay, et al., "Computationally Efficient Sine-Wave Synthesis and Its Application to Sinusoidal Transform Coding", IEEE 1988, pp. 370–373.

Hardwick, "A 4.8 Kbps Multi-Band Excitation Speech Coder", Thesis for Degree of Master of Science in Electrical Engineering and Computer Science, Massachusetts Institute of Technology, May 1988.

Griffin, "Multi-Band Excitation Vocoder", Thesis for Degree of Doctor of Philosophy, Massachusetts Institute of Technology, Feb. 1987.

Portnoff, "Short-Time Fourier Analysis of Sampled Speech", IEEE Transactions on Acoustics, Speech, and Signal Processing, vol. ASSP-29, No. 3, Jun. 1981, pp. 324–333.

Griffin, et al., "Signal Estimation from Modified Short-Time Fourier Transform", IEEE Transactions on Acoustics, Speech, and Signal Processing, vol. ASSP-32, No. 2, Apr. 1984, p. 236–243.

(List continued on next page.)

*Primary Examiner*—Allen R. MacDonald
*Assistant Examiner*—Robert Mattson
*Attorney, Agent, or Firm*—Fish & Richardson P.C.

[57] ABSTRACT

A speech decoder apparatus for synthesizing a speech signal from a digitized speech bit stream of the type produced by processing speech with a speech encoder. The apparatus includes an analyzer for processing the digitized speech bit stream to generate an angular frequency and magnitude for each of a plurality of sinusoidal components representing the speech processed by the speech encoder, the analyzer generating the angular frequencies and magnitudes over a sequence of times; a random signal generator for generating a time sequence of random phase components; a phase synthesizer for generating a time sequence of synthesized phases for at least some of the sinusoidal components, the synthesized phases being generated from the angular frequencies and random phase components; and a synthesizer for synthesizing speech from the time sequences of angular frequencies, magnitudes, and synthesized phases.

12 Claims, 1 Drawing Sheet

OTHER PUBLICATIONS

Almeida, et al., "Harmonic Coding: A Low Bit-Rate, Good-Quality Speech Coding Technique", IEEE (1982) CH1746/7/82, pp. 1664–1667.

Quatieri, et al., "Speech Transformations Based on a Sinusoidal Representation", IEEE Transactions on Acoustics, Speech, and Signal Processing, vol. ASSP-34, No. 6, Dec. 1986, pp. 1449–1464.

Griffin, et al., "Multiband Excitation Vocoder", IEEE Transactions on Acoustics, Speech, and Signal Processing, vol. 36, No. 8, Aug., 1988, pp. 1223–1235.

Almeida, et al., "Variable-Frequency Synthesis: An Improved Harmonic Coding Scheme", ICASSP 1984, pp. 27.5.1–27.5.4.

Flanagan, J. L., Speech Analysis Synthesis and Perception, Springer-Verlag, 1982, pp. 378–386.

METHOD AND APPARATUS FOR PHASE SYNTHESIS FOR SPEECH PROCESSING

This is a continuation of application Ser. No. 08/000,814, filed Jan. 5, 1993, now abandoned, which is a continuation of application Ser. No. 07/587,250, filed Sep. 24, 1990, now abandoned.

CROSS-REFERENCES TO RELATED APPLICATIONS

BACKGROUND OF THE INVENTION

The present invention relates to phase synthesis for speech processing applications.

There are many known systems for the synthesis of speech from digital data. In a conventional process, digital information representing speech is submitted to an analyzer. The analyzer extracts parameters which are used in a synthesizer to generate intelligible speech. See Portnoff, "Short-Time Fourier Analysis of Sampled Speech", IEEE TASSP, Vol. ASSP-29, No. 3, June 1981, pp. 364–373 (discusses representation of voiced speech as a sum of cosine functions); Griffin, et al., "Signal Estimation from Modified Short-Time Fourier Transform", IEEE, TASSP, Vol. ASSP-32, No. 2, April 1984, pp. 236–243 (discusses overlap-add method used for unvoiced speech synthesis); Almeida, et al., "Harmonic Coding: A Low Bit-Rate, Good-Quality Speech Coding Technique", IEEE, CH 1746, July 1982, pp. 1664–1667 (discusses representing voiced speech as a sum of harmonics); Almeida, et al., "Variable-Frequency Synthesis: An Improved Harmonic Coding Scheme", ICASSP 1984, pages 27.5.1–27.5.4 (discusses voiced speech synthesis with linear amplitude polynomial and cubic phase polynomial); Flanagan, J. L., *Speech Analysis, Synthesis and Perception*, Springer-Verlag, 1972, pp. 378–386 (discusses phase vocoder—frequency-based analysis/synthesis system); Quatieri, et al., "Speech Transformations Based on a Sinusoidal Representation", IEEE TAASP, Vol. ASSP34, No. 6, December 1986, pp. 1449–1986 (discusses analysis-synthesis technique based on sinusoidal representation); and Griffin, et al., "Multiband Excitation Vocoder", IEEE TASSP, Vol. 36, No. 8, August 1988, pp. 1223–1235 (discusses multiband excitation analysis-synthesis). The contents of these publications are incorporated herein by reference.

In a number of speech processing applications, it is desirable to estimate speech model parameters by analyzing the digitized speech data. The speech is then synthesized from the model parameters. As an example, in speech coding, the estimated model parameters are quantized for bit rate reduction and speech is synthesized from the quantized model parameters. Another example is speech enhancement. In this case, speech is degraded by background noise and it is desired to enhance the quality of speech by reducing background noise. One approach to solving this problem is to estimate the speech model parameters accounting for the presence of background noise and then to synthesize speech from the estimated model parameters. A third example is time-scale modification, i.e., slowing down or speeding up the apparent rate of speech. One approach to time-scale modification is to estimate speech model parameters, to modify them, and then to synthesize speech from the modified speech model parameters.

One technique for analyzing (encoding) speech is to break the speech into segments (e.g., using a Hamming window), and then to break each segment into a plurality of frequency bands. Each band is then analyzed to decide whether it is best treated as voiced (i.e., composed primarily of harmonics) or unvoiced (i.e., composed primarily of generally random noise). Voiced bands are analyzed to extract the magnitude, frequency, and phase of the harmonics in the band. The encoded frequency, magnitude, and phase are used subsequently when the speech is synthesized (decoded). A significant fraction of the available bandwidth is dedicated to representing the encoded phase.

SUMMARY OF THE INVENTION

In one aspect of the invention, we have discovered that a great improvement in the quality of synthesized speech, in speech coding applications, can be achieved by not encoding the phase of harmonics in voiced portions of the speech, and instead synthesizing an artificial phase for the harmonics at the receiver. By not encoding this harmonic phase information, the bits that would have been consumed in representing the phase are available for improving the quality of the other components of the encoded speech (e.g., pitch, harmonic magnitudes). In synthesizing the artificial phase, the phases and frequencies of the harmonics within the segments are taken into account. In addition, a random phase component, or jitter, is added to introduce randomness in the phase. More jitter is used for speech segments in which a greater fraction of the frequency bands are unvoiced. Quite unexpectedly, the random jitter improves the quality of the synthesized speech, avoiding the buzzy, artificial quality that can result when phase is artificially synthesized.

In one aspect of the invention, the phase $\Theta_k(t)$ of each harmonic k is determined from the fundamental frequency $\omega(t)$ according to voicing information $V_k(t)$. This method is simple computationally and has been demonstrated to be quite effective in use.

In another aspect of the invention an apparatus for synthesizing speech from digitized speech information includes an analyzer for generation of a sequence of voiced/unvoiced information, $V_k(t)$, fundamental angular frequency information, $\omega(t)$, and harmonic magnitude information signal $A_k(t)$, over a sequence of times $t_0 \ldots t_n$, a phase synthesizer for generating a sequence of harmonic phase signals $\Theta_k(t)$ over the time sequence $t_0 \ldots t_n$ based upon corresponding ones of voiced/unvoiced information $V_k(t)$ and fundamental angular frequency information $\omega(t)$, and a synthesizer for synthesizing speech based upon the generated parameters $V_k(t)$, $\omega(t)$, $A_k(t)$ and $\Theta_k(t)$ over the sequence $t_0 \ldots t_n$. The parameters $V_k(t)$, $\omega(t)$, and $A_k(t)$ at time $t_i$ are typically obtained from a speech segment obtained by applying a window to the speech signal. The window used is typically symmetric with respect to the center and the center of the window is placed at time $t_i$. The duration of the window is typically around 20 msec, over which speech may be assumed to be approximately stationary.

In another aspect of the invention a method for synthesizing speech from digitized speech information includes the steps of enabling analyzing digitized speech information and generating a sequence of voiced/unvoiced information signals $V_k(t)$, fundamental angular frequency information signals $\omega(t)$, and harmonic magnitude information signals $A_k(t)$, over a sequence of times $t_0 \ldots t_n$, enabling synthesizing a sequence of harmonic phase signals $\Theta_k(t)$ over the time sequence $t_0 \ldots t_n$ based upon corresponding ones of voiced/unvoiced information signals $V_k(t)$ and fundamental angular frequency information signals $\omega(t)$, and enabling synthesizing speech based upon the parameters $V_k(t)$, $\omega(t)$, $A_k(t)$ and $\Theta_k(t)$ over the sequence $t_0 \ldots t_n$.

In another aspect of the invention, an apparatus for synthesizing a harmonic phase signal $\Theta_k(t)$ over the sequence $t_0 \ldots t_n$ includes means for receiving voiced/unvoiced information $V_k(t)$ and fundamental angular frequency information $\omega(t)$ over the sequence $t_0 \ldots t_n$, means for processing $V_k(t)$ and $\omega(t)$ and generating intermediate phase information $\phi_k(t)$ over the sequence $t_0 \ldots t_n$, means for obtaining a random phase component $r_k(t)$ over the sequence $t_0 \ldots t_n$, and means for synthesizing $\Theta_k(t)$ over the sequence $t_0 \ldots t_n$ by addition of $r_k(t)$ to $\phi_k(t)$.

In another aspect of the invention, a method for synthesizing a harmonic phase signal $\Theta_k(t)$ over the sequence $t_0 \ldots t_n$ includes the steps of enabling receiving voiced/unvoiced information $V_k(t)$ and fundamental angular frequency information $\omega(t)$ over the sequence $t_0 \ldots t_n$, enabling processing $V_k(t)$ and $\omega(t)$, generating intermediate phase information $\phi_k(t)$ over the sequence $t_0 \ldots t_n$, and obtaining a random component $r_k(t)$ over the sequence $t_0 \ldots t_n$, and enabling synthesizing $\Theta_k(t)$ over the sequence $t_0 \ldots t_n$ by combining $\phi_k(t)$ and $r_k(t)$.

$$\phi_k(t_1) = \phi_k(t_o) + \int_{\tau = t_o}^{t_1} k\omega(\tau)d\tau$$

wherein the initial $\phi_k(t)$ can be set to zero or some other initial value;

$$\omega(t) = \omega(t_o) + (\omega(t_1) - \omega(t_o))\frac{t - t_o}{t_1 - t_o}, \quad t_o \leqq t \leqq t_1,$$

wherein $r_k(t)$ is expressed as follows:

$$r_k(t) = \alpha(t) \cdot u_k(t)$$

where $u_k(t)$ is a white random signal with $u_k(t)$ being uniformly distributed between $[-\pi, \pi]$, and where $\alpha(t)$ is obtained from the following:

$$\alpha(t) = \frac{N(t) - P(t)}{N(t)}$$

where $N(t)$ is the total number of harmonics of interest as a function of time according to the relationship of $\omega(t)$ to the bandwidth of interest, and the number of voiced harmonics at time t is expressed as follows:

$$P(t) = \sum_{k=1}^{N(t)} V_k(t).$$

Preferably, the random component $r_k(t)$ has a large magnitude on average when the percentage of unvoiced harmonics at time t is high.

Other advantages and features will become apparent from the following description of the preferred embodiment, from the appendix, and from the claims.

DETAILED DESCRIPTION OF THE PREFERRED EMBODIMENT

Figure 1:
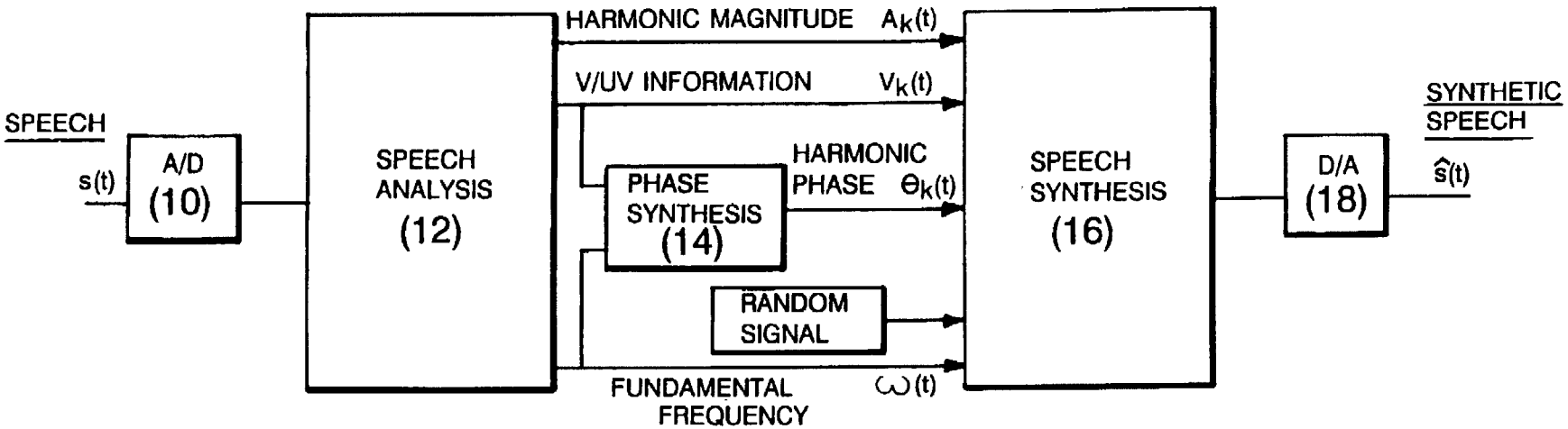

Various speech models have been considered for speech communication applications. In one class of speech models, voiced speech is considered to be periodic and is represented as a sum of harmonics whose frequencies are integer multiples of a fundamental frequency. To specify voiced speech in this model, the fundamental frequency and the magnitude and phase of each harmonic must be obtained. The phase of each harmonic can be determined from fundamental frequency, voiced/unvoiced information and/or harmonic magnitude, so that voiced speech can be specified by using only the fundamental frequency, the magnitude of each harmonic, and the voiced/unvoiced information. This simplification can be useful in such applications as speech coding, speech enhancement and time scale modification of speech.

We use the following notation in the discussion that follows:

- $A_k(t)$: kth harmonic magnitude (a function of time t).
- $V_k(t)$: voicing/unvoicing information for kth harmonic (as a function of time t).
- $\omega(t)$: fundamental angular frequency in radians/sec (as a function of time t).
- $\Theta_k(t)$: phase for kth harmonic in radians (as a function of time t).
- $\phi_k(t)$: intermediate phase for kth harmonic (as a function of time t).
- $N(t)$: Total number of harmonics of interest (as a function of time t).
- $t_i$: time samples at which parameters are estimated (i=0, . . . , n).

FIG. 1 is a block schematic of a speech analysis/synthesizing system incorporating the present invention, where speech s(t) is converted by A/D converter 10 to a digitized speech signal. Analyzer 12 processes this speech signal and derives voiced/unvoiced information $V_k(t_i)$, fundamental angular frequency information $\omega(t_i)$, and harmonic magnitude information $A_k(t_i)$. Harmonic phase information $\Theta_k(t_i)$ is derived from fundamental angular frequency information $\omega(t_i)$ in view of voiced/unvoiced information $V_k(t_i)$. These four parameters, $A_k(t_i)$, $V_k(t_i)$, $\Theta_k(t_i)$, and $\omega(t_i)$, are applied to synthesizer 16 for generation of synthesized digital speech signal which is then converted by D/A converter 18 to analog speech signal $\hat{s}(t)$. Even though the output at the A/D converter 10 is digital speech, we have derived our results based on the analog speech signal s(t). These results can easily be converted into the digital domain. For example, the digital counterpart of an integral is a sum.

More particularly, phase synthesizer 14 receives the voiced/unvoiced information $V_k(t_i)$ and the fundamental angular frequency information $\omega(t_i)$ as inputs and provides as an output the desired harmonic phase information $\Theta_k(t_i)$. The harmonic phase information $\Theta_k(t_i)$ is obtained from an intermediate phase signal $\phi_k(t_i)$ for a given harmonic. The intermediate phase signal $\phi_k(t_i)$ is derived according to the following formula:

$$\phi_k(t_{i+1}) = \phi_k(t_i) + \int_{\tau = t_i}^{t_{i+1}} k\omega(\tau)d\tau \tag{1}$$

where $\phi_k(t_i)$ is obtained from a prior cycle. At the very beginning of processing, $\phi_k(t)$ can be set to zero or some other initial value.

As described more clearly in a later section, the analysis parameters $A_k(t)$, $\omega(t)$, and $V_k(t)$ are not estimated at all times t. Instead the analysis parameters are estimated at a set of discrete times $t_0$, $t_1$, $t_2$, etc . . . . The continuous fundamental angular frequency, $\omega(t)$ used in Equation (1), can be obtained from the estimated parameters in various manners. For example, $\omega(t)$ can be obtained by linearly interpolating the estimated parameters $\omega(t_0)$, $\omega(t_1)$, etc. In this case, $\omega(t)$ can be expressed as $$\omega(t) = \omega(t_i) + (\omega(t_{i+1}) - \omega(t_i))\frac{t - t_i}{t_{i+1} - t_i}, \quad t_i \leqq t \leqq t_{i+1} \tag{2}$$

Equation 2 enables equation 1 as follows:

$$\phi_k(t_{i+1}) = \phi_k(t_i) + k\left(\frac{\omega(t_i) + \omega(t_{i+1})}{2}\right)(t_{i+1} - t_i) \tag{3}$$

Since speech deviates from a perfect voicing model, a random phase component is added to the intermediate phase component as a compensating factor. In particular, the phase $\Theta_k(t)$ for a given harmonic k over a sequence $t_0, \ldots, t_n$. Is expressed as the sum of the intermediate phase $\phi_k(t)$ and an additional random phase component $r_k(t)$, as expressed in the following equation:

$$\Theta_k(t) = \phi_k(t) + r_k(t), \quad t = t_0, t_1, \ldots, t_n \tag{4}$$

The random phase component typically increases in magnitude, on average, when the percentage of unvoiced harmonics increases, at time t. As an example, $r_k(t)$ can be expressed as follows:

$$r_k(t) = \alpha(t) \cdot u_k(t) \tag{5}$$

The computation of $r_k(t)$ in this example, relies upon the following equations:

$$P(t) = \sum_{k=1}^{N(t)} V_k(t) \tag{6}$$

where $$V_k(t) = \begin{cases} 1, \text{ if the } k\text{th harmonic is voiced} \\ 0, \text{ if the } k\text{th harmonic is unvoiced} \end{cases} \tag{7}$$

and $$\alpha(t) = \frac{N(t) - P(t)}{N(t)} \tag{8}$$

where P(t) is the number of voiced harmonics at time t and $\alpha(t)$ is a scaling factor which represents the approximate percentage of total harmonics represented by the unvoiced harmonics. It will be appreciated that where $\alpha(t)$ equals zero, all harmonics are fully voiced such that N(t) equals P(t). $\alpha(t)$ is at unity when all harmonics are unvoiced, in which case P(t) is zero. $\alpha(t)$ is obtained from equation 8. $u_k(t)$ is a white random signal with $u_k(t)$ being uniformly distributed between $[-\pi, \pi]$. It should be noted that N(t) depends on $\omega(t)$ and the bandwidth of interest of the speech signal s(t).

As a result of the foregoing it is now possible to compute $\phi_k(t)$, and from $\phi_k(t)$ to compute $\Theta_k(t)$. Hence, it is possible to determine $\phi_k(t)$ and thus $\Theta_k(t)$ for any given time based upon the time samples of the speech model parameters $\omega(t)$ and $V_k(t)$. Once $\Theta_k(t_1)$ and $\phi_k(t_1)$ are obtained, they are preferably converted to their principal values (between zero and $2\pi$). The principal value of $\phi_k(t_1)$ is then used to compute the intermediate phase of the kth harmonic at time $t_2$, via equation 1.

The present invention can be practiced in its best mode in conjunction with various known analyzer/synthesizer systems. We prefer to use the MBE analyzer/synthesizer. The MBE analyzer does not compute the speech model parameters for all values of time t. Instead, $A_k(t)$, $V_k(t)$ and $\omega(t)$ are computed at time instants $t_0, t_1, t_2, \ldots t_n$. The present invention then may be used to synthesize the phase parameter $\Theta_k(t)$ at time instants $t_0, t_1, \ldots, t_n$. Even though $A_k(t)$, $V_k(t)$, $\omega(t)$, and $\Theta_k(t)$ are typically computed at the same time instants $t_0, t_1, \ldots, t_n$, it is not necessary to do so. For example, it is possible to compute $\Theta_k(t)$ at time instants different from $t_0, t_1, \ldots, t_n$ if desired. In the MBE system, the synthesized phase parameter along with the sampled model parameters are used to synthesize a voiced speech component and an unvoiced speech component. The voiced speech component can typically be represented as $$\hat{s}_v(t) = \sum_{k=1}^{N(t)} \hat{A}_k(t) \cdot \cos\hat{\theta}_k(t) \tag{9}$$

where $$\hat{\theta}_k(t) = \int_{\tau = t_o}^{t} \hat{\omega}_k(\tau)d\tau + \hat{\theta}_k(t_o). \tag{10}$$

Typically $\hat{\Theta}_k(t)$ is chosen to be some smooth function (such as a low-order polynomial) that attempts to satisfy the following conditions for all sampled time instants $t_i$ at which $\Theta_k(t)$ is obtained:

$$\hat{\theta}_k(t_i) = \theta_k(t_i), \tag{11}$$

and $$\left.\frac{d\hat{\theta}_k(t)}{dt}\right|_{t=t_i} = \omega_k(t_i) = k\omega(t_i). \tag{12}$$

Other reasonable conditions such as those disclosed in Griffin et al. may also be used. Note that $\hat{\Theta}_k(t)$ used in the speech synthesis is obtained by interpolating the values of $\Theta_k(t)$ at time samples $t_0, \ldots, t_n$.

Typically $\hat{A}_k(t)$ is chosen to be some smooth function (such as a low-order polynomial) that satisfies the following conditions for all sampled time instants $t_i$:

$$\hat{A}_k(t_i) = A_k(t_i). \tag{13}$$

Typically, the function $\hat{\omega}_k(t)$ is chosen by some smooth interpolation that satisfies the following conditions for all sampled time instants $t_i$:

$$\hat{\omega}_k(t_i) = \omega_k(t_i) \tag{14}$$

Unvoiced speech synthesis is typically accomplished with the known weighted overlap-add algorithm. The sum of the voiced speech component and the unvoiced speech component is equal to the synthesized speech signal $\hat{s}(t)$. In the MBE synthesis of unvoiced speech, the phase $\Theta_k(t)$ is not used. Nevertheless, the intermediate phase $\phi_k(t)$ has to be computed for unvoiced harmonics as well as for voiced harmonics. The reason is that the kth harmonic may be unvoiced at time t' but can become voiced at a later time t". To be able to compute the phase $\Theta_k(t)$ for all voiced harmonics at all times, we need to compute $\phi_k(t)$ for both voiced and unvoiced harmonics.

The present invention has been described in view of particular embodiments. However, the invention applies to many synthesis applications where synthesis of the harmonic phase signal $\Theta_k(t)$ is of interest.

Other embodiments are within the following claims. For example, other speech synthesis methods may be used. A specific example of a speech synthesis method that utilizes the invention is shown in the INMARSAT Standard M Voice Codec Definition Manual available from INMARSAT.

We claim:

1. A speech decoder apparatus for synthesizing a speech signal from a digitized speech bit stream of the type produced by processing speech with a speech encoder, said apparatus comprising an analyzer for processing said digitized speech bit stream to generate an angular frequency and magnitude for each of a plurality of sinusoidal voiced frequency components representing the speech processed by the speech encoder, said analyzer generating said angular frequencies and magnitudes over a sequence of times;

a random signal generator for generating a time sequence of random phase components;

a phase synthesizer for generating a time sequence of synthesized phases for at least some of said sinusoidal voiced frequency components, said synthesized phases being generated from said angular frequencies and random phase components;

a first synthesizer for synthesizing the voiced frequency components of speech from said time sequences of angular frequencies, magnitudes, and synthesized phases; and a second synthesizer for synthesizing unvoiced frequency components representing the speech processed by the speech encoder, using a technique different from the technique used for synthesizing the voiced frequency components;

wherein the speech signal is synthesized by combining synthesized voiced and unvoiced frequency components coexisting at the same time instants.

2. The apparatus of claim 1 wherein said sinusoidal voiced frequency components are harmonic components of the speech being synthesized.

3. The apparatus of claim 1 wherein said encoder encodes a percentage of said speech as unvoiced components, and the random phase components used by said phase synthesizer have larger magnitudes on average when the percentage of unvoiced components is higher.

4. The apparatus of claim 1, 2, or 3 wherein said synthesis performed by the first and second synthesizers is MBE (multi-band excitation) synthesis and said digitized speech bit stream was encoded with an MBE speech encoder.

5. The apparatus of claim 4 wherein said phase synthesizer generates said time sequence of synthesized phases by summing intermediate phases with said random phase components.

6. The apparatus of claim 1, 2, or 3 wherein said digitized speech bit stream has been encoded with a sinusoidal transform coder.

7. A method of decoding speech by synthesizing a speech signal from a digitized speech bit stream of the type produced by processing speech with a speech encoder, said method comprising the steps of:

processing said digitized speech bit stream to generate an angular frequency and magnitude for each of a plurality of sinusoidal voiced frequency components representing the speech processed by the speech encoder, and generating said angular frequencies and magnitudes over a sequence of times;

generating a time sequence of random phase components;

generating a time sequence of synthesized phases for at least some of said sinusoidal voiced frequency components, said synthesized phases being generated from said angular frequencies and random phase components;

synthesizing the voiced frequency components of speech from said time sequences of angular frequencies, magnitudes, and synthesized phases;

synthesizing unvoiced frequency components representing the speech processed by the speech encoder, using a technique different from the technique used for synthesizing the voiced frequency components; and synthesizing the speech signal by combining synthesized voiced and unvoiced frequency components coexisting at the same time instants.

8. The method of claim 7 wherein said sinusoidal voiced frequency components are harmonic components of the speech being synthesized.

9. The method of claim 7 wherein said encoder encodes a percentage of said speech as unvoiced components, and the random phase components used in phase synthesis have larger magnitudes on average when the percentage of unvoiced components is higher.

10. The method of claim 7, 8, or 9 wherein said synthesis performed by the first and second synthesizers is MBE (multi-band excitation) synthesis and said digitized speech bit stream has been encoded with an MBE speech encoder.

11. The method of claim 10 wherein said phase synthesis generates said time sequence of synthesized phases by summing intermediate phases with said random phase components.

12. The method of claim 7, 8, or 9 wherein said digitized speech bit stream has been encoded with a sinusoidal transform coder.

* * * * *